US005374347A

United States Patent [19]

Pearlstein et al.

[11] Patent Number: 5,374,347

[45] Date of Patent: Dec. 20, 1994

[54] TRIVALENT CHROMIUM SOLUTIONS FOR SEALING ANODIZED ALUMINUM

[75] Inventors: Fred Pearlstein, Philadelphia; Vinod S. Agarwala, Warminster, both of Pa.

[73] Assignee: The United States of America as represented by the Secretary of the Navy, Washington, D.C.

[21] Appl. No.: 134,762

[22] Filed: Oct. 1, 1993

Related U.S. Application Data

[63] Continuation-in-part of Ser. No. 126,869, Sep. 27, 1993, Pat. No. 5,304,257.

[51] Int. Cl.[5] ..... C23C 22/56

[52] U.S. Cl. ..... 205/203; 148/276; 148/267; 427/343; 205/201

[58] Field of Search ..... 205/203, 201; 148/267, 148/276; 427/343

[56] References Cited

U.S. PATENT DOCUMENTS

| | | | |
|---|---|---|---|
| 4,171,231 | 10/1979 | Bishop | 148/267 |
| 4,359,346 | 11/1982 | Da Fonte | 148/267 |
| 5,304,257 | 4/1991 | Pearlstein | 148/265 |

*Primary Examiner*—Sam Silverberg

*Attorney, Agent, or Firm*—James V. Tura; James B. Bechtel; Susan E. Verona

[57] ABSTRACT

Corrosion resistant seal-coatings are formed on anodized aluminum by immersion in aqueous solutions containing trivalent chromic compounds with an alkali added near or slightly beyond the precipitation of insoluble basic compounds. Trivalent chromium seals formed on the anodized aluminum when tested in 5% NaCl salt spray chamber showed improved corrosion resistance. After a post-treatment in a peroxide or permanganate solution, the corrosion resistance for the anodized aluminum showed even greater improvement in the salt chamber.

11 Claims, No Drawings

TRIVALENT CHROMIUM SOLUTIONS FOR SEALING ANODIZED ALUMINUM

STATEMENT OF GOVERNMENT INTEREST

The invention described herein may be manufactured and used by or for the Government of the United States of America for governmental purposes without the payment of any royalties thereon or therefor.

CONTINUATION APPLICATION

This application is a continuation-in-part of co-pending application Ser. No. 08/126869 filed Sep. 27, 1993 by Fred Pearlstein and Vinod S. Agarwala now U.S. Pat. No. 5,304,257.

BACKGROUND OF THE INVENTION

This invention relates to a method of treating metal surfaces to enhance corrosion resistant and paint bonding characteristics and more particularly, relates to trivalent chromium seal-coatings for anodized aluminum substrates.

It is generally known to treat the surfaces of metals, such as zinc, cadmium, or aluminum with aqueous chromate (hexavalent chromium) solutions which contain chemicals that dissolve the surface of the metal and form insoluble films known as "chromate conversion coatings." These chromium coatings, are corrosion resistant and protect the metal from various elements which cause corrosion. In addition, it is known that chromate conversion coatings generally have good paint bonding characteristics and, therefore, provide an excellent base for paint or other finishes.

Although the aforementioned coatings enhance corrosion resistant and paint bonding properties, the coatings have a serious drawback, i.e., the toxic nature of the hexavalent chromium constituent. This is a serious problem from two viewpoints, one being the handling of the solution by operators and the other, the disposal of the used solution. The disposal problem, however, can be mitigated by reducing the hexavalent chromium to the comparatively innocuous trivalent form before disposal. This method is expensive and therefore can be a major cost factor in the overall metal treating process. Therefore, it is highly desirable to have coatings which are substantially free of hexavalent chromium, but at the same time capable of imparting corrosion resistant and paint bonding properties which are comparable to those imparted by conventional chromium coatings.

Of particular interest is the use of chromate conversion coatings on aircraft aluminum alloys due to the excellent corrosion resistance and the ability to serve as an effective base for paint. The baths used to develop these coatings contain chromates, i.e., hexavalent chromium, and it is the residual chromates in the coating that is largely responsible for the high degree of corrosion inhibition. However, these same chromates are highly toxic and their presence in waste water effluents is severely restricted. It would therefore, be desirable to provide a coating for aluminum and its alloys and, more particularly a seal coating for anodized aluminum utilizing relatively non-toxic chemicals that could serve as an alternative to the toxic hexavalent chromate coatings.

For example, in the prior art, trivalent chromium baths (U.S. Pat. No. 4,171,231) have been used to produce coatings on zinc or zinc plate to provide a decorative "clear to light blue finish" which is characterized as having superior corrosion resistance. These baths are stated to contain "trivalent" chromium as substantially the only chromium ion, with a fluoride ion, an acid other than nitric acid and an oxidizing agent. The operating range of the baths is at a pH ranging from about 2 to 4 and preferably between 1 and 3. The baths are used to achieve a single-dip chromate finish on all types of zinc plate. The implication is that the presence of the oxidizer, in situ, produces hexavalent chromium on the zinc surface without any oxidation or conversion of the trivalent chromium in the bath to the hexavalent form. Patentee discloses further that without the oxidizing agent in the bath, corrosion resistance on the zinc plate was poor, i.e., extensive corrosion after 24 hours with a 5% salt spray exposure, whereas with the oxidizing agent in the bath there was 0–10% of white corrosion and some panels were free of white salt after 50 hours of salt spray exposure.

This invention, in comparison, utilizes trivalent chromium as the only chromium ion in the solution at a specific pH range and is specifically applied to aluminum alloys. It was found that the addition of an oxidizing agent such as peroxide to the solution, in situ, slowly oxidized the trivalent chromium to the toxic hexavalent form. This conversion to the hexavalent form is contrary to the method used by this invention; namely, utilization of a bath composition completely free of hexavalent chromium and containing no oxidizing agent.

With regard to anodized aluminum it is known to apply anodic coatings to aluminum by making the metal anodic in a suitable solution and with a suitable counter electrode (cathode). The application of an anodic current converts the surface of aluminum to aluminum oxide which is characteristically hard and wear resistant. The anodic coatings are usually microporous and can be sealed with dyes to obtain desired colors or with other solutions to improve corrosion resistance or to attain desired surface characteristics.

Some of the more commonly used solutions for applying anodic coatings on aluminum include sulfuric acid, chromic acid, oxalic acid, sulfophthalic acid, boric acid or combinations of these. For example, aluminum alloys are readily anodized in 15 percent sulfuric acid by application of 12 amps/ft$^2$ anodic current at 21° C. The anodic coatings usually range from 0.1 to 1 mil in thickness depending upon treatment time and alloy. The anodic coatings can be sealed in boiling water which hydrates and swells the coating and thereby closes the pores. In this manner, the corrosion resistance is improved and the surface less susceptible to staining by contact with colored materials. However, for optimum corrosion resistance, normally required for military equipment, anodic coatings are sealed in dichromates, usually 5 to 30 minute immersion in 50 g/l sodium dichromate solution at 85° to 100° C. The dichromate absorbed by the coating acts as an effective inhibitor to provide long lasting corrosion resistance even in very severe environments. For example, a proprietary anodic hard coating applied to 7075-T6 aluminum M-16 rifle components had a strong tendency to undergo catastrophic exfoliation corrosion during service in Vietnam. Sealing in dichromate prevented this corrosion phenomenon.

The dichromate (hexavalent chromium) has a serious drawback, however, inasmuch as the compound is highly toxic and presents an environmental health hazard to operators. Moreover, the presence of hexavalent chromium in waste effluents are severely restricted. In order to dispose of hexavalent chromium, it is necessary to use a chemical reducing agent to convert the hexavalent to the much less toxic trivalent form. The reduction process is expensive and reduction is often incomplete which leads to violations of EPA standards. Therefore, it is highly desirable to achieve corrosion resistance of anodized aluminum comparable to that of dichromate sealing, by utilizing relatively nontoxic chemicals that can serve as an alternative to the use of hexavalent chromium. Accordingly, this invention utilized trivalent chromium as the only chromium ion in the bath for the treatment or sealing of anodized aluminum.

SUMMARY OF THE INVENTION

This invention relates to a process for preparing a corrosion-resistant trivalent chromium coating or seal-coating on anodized aluminum substrates which comprises treating said substrates with an aqueous solution containing from about 0.1 to 10 g/l of a water soluble trivalent chromium compound, and a sufficient amount of an alkaline reagent to maintain the aqueous solution at a pH ranging from about 3.3 to 5.5 sufficient to convert the chromium compound to the more basic soluble trivalent compounds thereby forming the trivalent-chromium, seal-coating on the anodized aluminum. The trivalent-chromium seal-coatings formed on the anodized aluminum in accordance with this invention may be further improved with respect to corrosion by subsequently post-treating the trivalent chromium seal-coating with effective amounts of an oxidizing agent, e.g., solution of peroxide.

It is therefore an object of this invention to provide an improved composition for sealing anodized aluminum that contains no hexavalent chromium or other highly toxic materials.

It is another object of this invention to provide a composition for sealing anodized aluminum which contains only trivalent chromium.

It is still a further object of this invention to provide a trivalent chromium-containing solution wherein said chromium has little or no tendency to precipitate from the solution.

It is a further object of this invention to provide a method of preparing a trivalent chromium seal-coating on anodized aluminum.

It is a further object of this invention to provide a method of sealing anodized aluminum with trivalent chromium followed by a post-treatment to obtain improved corrosion resistance.

These and other objects will become apparent to those skilled in the art from the description of the invention as follows.

DETAILED DESCRIPTION OF THE PREFERRED EMBODIMENT

In producing a corrosion-resistant coating on an aluminum surface, generally the surface is cleaned of soil and oxides which interfere with the coating process. The surface can be cleaned by any convenient method known to the art. Continuous water rinses, for example, are suitable to remove any residual materials from the surface. It is necessary only that the surface be clean of all organic and inorganic residue. Subsequent to the cleaning and rinsing, the anodized aluminum surface is treated with the trivalent chromium seal-coating solution of this invention.

Various methods of contacting the anodized aluminum surface with the coating solution commonly employed in the metal coating art is acceptable. For example, the anodized aluminum surfaces or substrates can be treated or contacted by spraying, dipping, roller coating, or the like. The chromium coating or sealer is formed on the aluminum surface at temperatures ranging from as low as about 16° C. up to the boiling point. Although the sealing solution or bath can be employed at room temperatures, it is preferred that the seal-coating operation be performed in heated baths, i.e., between about 60° C. and 100° C.

More specifically, the process of this invention requires a critical amount of alkali (usually an alkali metal hydroxide) to be added to the bath to promote hydrolysis and conversion of the trivalent chromium compounds to more basic forms. The proper amount of alkali (usually as 0.5N to 6N NaOH solution) added to a bath is determined by dispensing the alkali to the bath with agitation, while maintaining the pH between a preferred range of about 4.0 and 5.5 for about 5 to 30 minutes or until a precipitate persists in the bath. The most preferred pH range is between 4.1 to 4.7 for about 5 to 10 minutes. After aging, the pH will usually equilibrate at 3.3 to 3.8. The sealer of this invention when applied to the anodized aluminum will usually require 2000 to 3000 hours exposure to salt spray before the first appearance of corrosion. This is without any hexavalent chromium in the bath. The absence of $Cr^{+6}$ was determined by analysis of the bath by atomic absorption spectroscopy and the Hach Test Kit.

Further, the process of this invention includes a post-treatment in a dilute oxidizer e.g., 10 ml/liter $H_2O_2$ (30%) to further improve the corrosion resistance of the trivalent chromium-containing seal-coating to salt spray exposure. The primary coating of this invention is substantially free of hexavalent chromium and since the post-treatment requires no water rinse, there is no $Cr^{+6}$ in the waste stream. Occasionally, it may be necessary to discard the post-treatment bath, but the quantity of $Cr^{+6}$ in the bath is minuscule and will have virtually no environmental impact. Based on chemical analysis of a used post-treatment (peroxide) bath, the total hexavalent Cr content was found to be less than 0.01 p.p.m. This value is below the allowable limits for occasional discharge and therefore presents no difficulties.

Further, in accordance with this invention the corrosion resistant sealers can be applied to anodized aluminum alloys (2024-T3 and 7075-T6) by immersion in baths consisting essentially of chromic sulfate. A 15 minute immersion time at 25° C. in the trivalent chromium bath was required to pass 2000 hours of salt spray corrosion resistance.

It was found that insoluble trivalent chromium compounds could indeed be formed on anodized aluminum. It was further found possible to improve the seal coat by subsequently oxidizing or post-treating the coating. The post-treatment comprises a dilute solution of peroxide, e.g., 0.2 to about 20% by volume of $H_2O_2$ (30%). Thus, it was possible to prepare a corrosion resistant seal-coating on anodized aluminum comparable to other chromate coatings without the use of toxic hexavalent chromium. It is generally well known that trivalent chromium is substantially less toxic than the hexavalent form.

More specifically, it was found that coating baths containing $Cr_2(SO_4)_3$ when brought with NaOH to near or slightly beyond precipitation of the basic compounds, were capable of forming light, but visible films on anodized A1-alloys which had significant corrosion resistance. As the pH was raised by the addition of NaOH, the pH would fall with time to considerably lower values. The reason being that trivalent chromium salts form coordination compounds of coordination number six. The hydrolysis of coordination complexes is accelerated by addition of alkali and forms successively in the following manner:

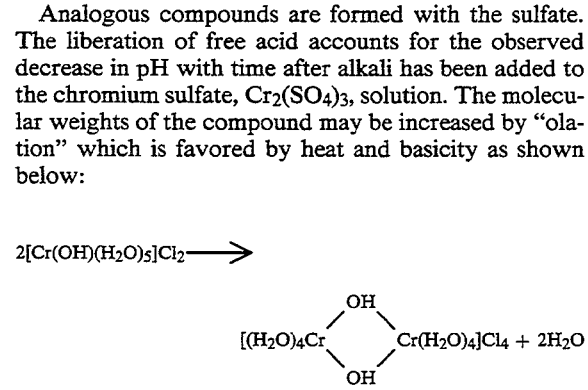

$$[Cr(H_2O)_6]Cl_3 \rightarrow [Cr(OH)(H_2O)_5]Cl_2 + HCl$$

$$[Cr(OH)(H_2O)_5]Cl_2 \rightarrow [Cr(OH)_2(H_2O)_4]Cl + HCl$$

$$[Cr(OH)_2(H_2O)_4]Cl \rightarrow [Cr(OH)_3(H_2O)_3] + HCl$$

Analogous compounds are formed with the sulfate. The liberation of free acid accounts for the observed decrease in pH with time after alkali has been added to the chromium sulfate, $Cr_2(SO_4)_3$, solution. The molecular weights of the compound may be increased by "olation" which is favored by heat and basicity as shown below:

$$2[Cr(OH)(H_2O)_5]Cl_2 \longrightarrow [(H_2O)_4Cr(OH)_2Cr(H_2O)_4]Cl_4 + 2H_2O$$

This invention relates to a process for treatment of anodized aluminum substrates by immersion in a mildly acid solution containing 0.1 to 10 g/l of a water soluble trivalent chromium compound and an alkali solution dispensed with agitation to an extent equivalent to about 4 to 30 ml of 0.5N NaOH per gram of trivalent chromium in the bath. The amount of alkali added will depend to some extent upon the trivalent chromium compound used but should not exceed an amount that results in first formation of a persistent precipitate in the bath (slightly cloudy solution). When basic chromium sulfate is used [$Cr_4(SO_4)_5(OH)_2$-Fluka Co.; 26% $Cr_2O_3$ and 23–24% $Na_2SO_4$], an appropriate amount of alkali addition is 10 to 20 ml of 0.5N NaOH per gram of trivalent chromium. The effectiveness of the treatment may even further be improved by subsequently post-treating the coating, after trivalent chromium treatment and rinsing, with an effective amount of an oxidizing agent, e.g., peroxide or permanganate solution such as by immersion, spray or otherwise contacting the surface with a dilute solution of oxidizer. For comparison purposes, non-anodized aluminum alloys (7075-T6 and 2024-T3) panels, 3"×5"×0.030", were held on titanium racks and treated as follows:

a) Immersed 30 minutes in proprietary alkaline cleaner [53 g/l Turco 4215-NC-LT] at 55° C. with air agitation and followed by room temperature running water rinses;

b) Immersed 15 minutes in proprietary nonchromate deoxidizer [180 g/l Turco Smut-Go] at 25° C. and followed by room temperature running water rinses;

c) Immersed in 12 liter trivalent chromium bath as described above at 25° C. without agitation for 5, 10, 20 or 40 minutes and given one of the following post treatments:

(1) None (2) 30 seconds in 10 ml/l $H_2O_2$ (30%) in deionized water at 25° C.; drain dried without rinsing.

(3) 30 seconds in 5 g/l $KMnO_4$ at 25° C.; water rinsed and drain dried.

A scribe mark was made on each panel to ascertain whether there was any tendency for self-healing as is achieved with chromate conversion coatings. The panels were exposed to 5% neutral salt spray, in accordance with ASTM B-117 Standard Method. Visible films were produced on aluminum panels immersed 10 or more minutes in the trivalent chromium bath; pale tan at 10 minutes, pale violet at 20 minutes and pale blue at 40 minutes. The panels post-treated in permanganate were somewhat darker colored.

Film formation may initiate with attack (oxidation) of the aluminum surface by fluoride-containing ions. The pH of the interfacial solution is increased leading to intimate precipitation of insoluble hydrous chromic oxides on the surface. However, electrochemical studies indicate that the mechanism is more complex. The film weight of panels, immersed 10 minutes in the trivalent chromium bath, was determined by stripping the film for 30 minutes in solution containing 35 ml/l $H_3PO_4$ (85%) + 20 g/l $CrO_3$ at the boiling point, rinsing, drying and reweighing. The loss of weight averaged 3.8 mg per panel or 18 mg/ft$^2$.

The results of salt spray exposures of panels treated various times in trivalent chromium bath are shown in Table I. After 336 hours exposure, the 7075-T6 panels that had been immersed 10, 20 or 40 minutes in trivalent chromium bath and provided with a permanganate post-treatment were free of corrosion or had only faint traces of corrosion. All 7075-T6 panels provided with the peroxide post-treatment were only slightly corroded. Panels immersed in trivalent chromium bath for 5 or 10 minutes without any post-treatment had only slight corrosion while those immersed 20 or 40 minutes were somewhat more corroded. In general, best corrosion resistance was obtained when panels were immersed 10 minutes. There was little evidence of self-healing at the scribe mark made in the 7075-T6 panels.

TABLE I

Corrosion Ratings* of Panels Treated in Trivalent Chromium Bath After 336 Hours Salt Spray Exposure.

| Immersion Time, Minute | Post-Treatment: None | 30 s, 10 ml/l $H_2O_2$ (30%) | 30 s, 5 g/l $KMnO_4$ Water Rinsed |
|---|---|---|---|
| | | Al 7075-T6 Alloy | |
| 5 | 3 | 3+ | 3+ |
| 10 | 3 | 3+ | 5 |
| 20 | 2+ | 3 | 4+ |
| 40 | 2+ | 3 | 4+ |
| | | Al 2024-T3 Alloy | |
| 5 | 0+ | 3 | 2 |
| 10 | 1 | 3 | 5 |
| 20 | 1+ | 2+ | 5 |
| 40 | 1 | 2+ | 5 |

*Rating Key
5 - No Corrosion
4 - Traces of Corrosion (incipient)
3 - Slight Corrosion (<1% area affected)
2 - Moderate Corrosion (1–5% area affected)
1 - Considerable Corrosion (5–25% area affected)
0 - Extensive Corrosion (>25% area affected)

The 2024-T3 panels after 336 hours salt spray exposure were completely uncorroded when trivalent chromium treated for 10 minutes or more and subjected to the permanganate post-treatment. There was only slight corrosion on panels treated 5 or 10 minutes and subjected to the peroxide post-treatment. Somewhat more corrosion was seen on the panels treated 20 or 40 minutes in trivalent chromium. In general, as found for the 7075-T6 panels, the best corrosion resistance was obtained after 10 minutes treatment in trivalent chromium. With 2024-T3 panels that were not subjected to a post-treatment, corrosion resistance showed considerable amounts of white salts. However, even the poorest of these were not nearly as badly corroded as bare (untreated) panels which were 95% covered with heavy white salts. The 2024-T3 panels showed self-healing properties at the scribe areas when a post-treatment was applied to those trivalent chromium treated 10 minutes or more.

Self-healing is believed to be due to the small amount of hexavalent chromium introduced into the coating by the peroxide or permanganate post-treatment. A panel treated for 10 minutes in the trivalent chromium bath and post treated with peroxide was leached 30 minutes in 200 ml of boiling water. The water was found to contain 0.05 p.p.m. of hexavalent chromium. A control panel, not peroxide post-treated, had no hexavalent chromium. Total chromium in the coating was determined by dissolving the films 5 minutes in 25% (vol.) HCl at 25° C. and analyzing for Cr by atomic absorption spectroscopy. The solution contained 3.36 p.p.m. Cr or 0.73 mg Cr removed per panel. This indicates that only about 19% [0.73/3.8×100] of the films contain Cr. Hydrous chromic oxide would not account for more than about 40% of the film. It is, therefore, considered likely that aluminum compounds comprise much of the weight of the conversion coating.

There was significant benefit in corrosion resistance to using permanganate post treatment over peroxide; however, the latter is simpler and less polluting and is preferred when optimum corrosion resistance is not required. The trivalent chromium bath treatment was even more effective for the protection of 6061-T4 aluminum than 7075-T6 or 2024-T3.

It is important to note that baths controlled by pH alone is not sufficient to ensure a good operating bath. However, the amount of alkali added is critical. Baths were prepared with 4 grams per liter of Fluka salt, $Cr_4(SO_4)_5(OH)_2$+0.4 g/l $Na_2SiF_6$ and various amounts of alkali added to obtain optimum pH. The baths were allowed to stand 2 weeks, pH measured, panels immersed 5 minutes at 25° C. and subjected to a peroxide post-treatment. The results are as shown in Table II.

TABLE II

The data shows the effect of sodium hydroxide addition on the corrosion resistance of aluminum alloys treated in the trivalent chromium bath. All panels were post treated in peroxide.

| Volume, ml N/2 NaOH Added/ Liter | pH After Standing 2 Weeks | Corrosion Rating* After Salt Spray Exposure | | | | | |
|---|---|---|---|---|---|---|---|
| | | 7075-T6 | | | 2024-T3 | | |
| | | 96 h | 168 h | 336 h | 96 h | 168 h | 336 h |
| 0 | 3.36 | 0 | 0 | 0 | 0 | 0 | 0 |
| 4 | 3.51 | 0 | 0 | 0 | 0 | 0 | 0 |
| 8 | 3.61 | 0 | 0 | 0 | 0 | 0 | 0 |
| 12 | 3.64 | 5 | 3+ | 3 | 4 | 3 | 2 |
| 16 | 3.68 | 5 | 4 | 3+ | 4 | 3 | 2+ |
| 20 | 3.71 | 5 | 4 | 4 | 4 | 3 | 2+ |

*See Table I for Rating Key.

The data shows that there is a critical transition between 8 and 12 ml/l of 0.5N NaOH addition. Solutions with 8 ml/l or less NaOH addition were incapable of providing protection to aluminum while those with 12 ml/l or more provided effective protection. The difference in pH was minimal (3.61 vs. 3.64). It is important to note that there was no precipitation in the bath with 12 ml/l of 0.5N NaOH, slight precipitation with 16 ml/l and moderate precipitation with 20 ml/l. Results of salt spray exposure on the corrosion ratings are shown in the above table. There is some increase in corrosion resistance with increasing 0.5N NaOH addition from 12 to 20 ml/l though the bath with 12 ml/l added had the benefit of no loss of trivalent chromium through precipitation.

Additional panels were treated in the solutions containing 12, 16 or 20 ml/l of 0.5N NaOH for only 2.5 minutes at 25° C. The baths were then heated to 42° C. and the tests repeated. The results of salt spray exposure tests on these panels are shown in Table III. All panels were post-treated in peroxide solutions.

TABLE III

The data shows the effects of non-heated and heated trivalent chromium bath temperature on corrosion resistance of treated aluminum.

| Volume, ml/l 0.5 N NaOH Added | Corrosion Rating* After 168 Hours Salt Spray Exposure | | | |
|---|---|---|---|---|
| | 2.5 min. at 25° C. | | 2.5 min. 42° C. | |
| | 7075-T6 | 2024-T3 | 7075-T6 | 2024-T3 |
| 12 | 0 | 0 | 3 | 2+ |
| 16 | 1 | 0 | 3+ | 3 |
| 20 | 2+ | 2 | 3+ | 3 |

*See Table 1 for Rating Key.

Panels immersed 2.5 minutes at 25° C. in the trivalent chromium baths were generally poor even though the bath containing 20 ml/l of 0.5N NaOH provided substantially greater corrosion resistance than baths containing lesser amounts. Increasing the bath temperature to 42° C. considerably improved the corrosion resistance of panels immersed 2.5 minutes. Immersion of panels for 2.5 minutes at 42° C. provided approximately the same corrosion resistance as panels immersed 5 minutes at 25° C. Thus, it has been demonstrated that increasing the trivalent chromium bath temperature can substantially reduce the required treatment time. After the 12 liter bath was used to treat approximately 150 panels (2.6 $ft^2$ per liter processed) the bath was reduced in effectiveness for providing corrosion resistance. However, it was found that addition of 0.4 g/l of $Na_2SiF_6$ with a small amount of NaOH rejuvenated the bath to previous effectiveness.

Although basic chromium sulfate was used in the above tests, ordinary chromic sulfate $\{Cr_2(SO_4)_3\}$ is similarly effective. Trivalent chromium solutions other than sulfate have been studied briefly; chloride, nitrate or acetate was not as effective as sulfate. However, a simple solution of 2.5 g/l $CrF_3.9H_2O$ properly adjusted with alkali showed some promise.

Preliminary tests showed that corrosion resistant films can be applied to aluminum by a wiping-on procedure using absorbent material soaked with the trivalent chromium solution. Post-treatment was applied, after rinsing, by a fine spray of dilute peroxide solution to cover the surface which was then allowed to dry. These results indicate that the process can be used effectively for treating large surfaces for which an immersion process is impracticable.

Panels treated in the 12 liter trivalent chromium bath for 5 or 20 minutes, with or without peroxide post-treatment, were painted with epoxy primer (MIL-23377), aged one week, immersed in distilled water 24 hours at room temperature, dried, scribed and tape-tested in accordance with ASTM D3359. Bare panels failed the tape-test while all trivalent chromium treated panels, with or without peroxide post-treatment, passed the paint adhesion tests.

DETAILED DESCRIPTION OF THE PREFERRED EMBODIMENT

To produce improved corrosion resistance on anodized aluminum, the anodized parts are rinsed and contacted with the trivalent chromium solution. The anodized surfaces can be contacted by immersion, spraying or wiping-on. Acceptable treatments are applied at temperatures ranging from below ambient to boiling. It is preferred that the treatment be applied by immersion at 60° to 100° C. for maximum effectiveness. The process of this invention requires that a certain amount of alkali (usually NaOH as 0.5 to 6N solution) be added to the trivalent chromium bath to promote hydrolysis and conversion of the dissolved chromium compound to more basic soluble forms. In general, this amount will be 10 to 20 ml of 0.5N NaOH equivalent dispensed for each gram of $Cr+3$ in the solution with agitation when the salt is $Cr_4(SO_4)_5(OH)_2$ [Fluka Co.; 26% $Cr_2O_3$ and 23–24% $Na_2SO_4$] or somewhat greater amounts when the salt is $Cr_2(SO_4)_3$.

The pH at room temperature of the sealing solution is usually in the range of about 3.3 to 3.8 at equilibrium. Chromic sulfate is the preferred salt but other trivalent chromium salts may be used. Unlike the baths used for producing chemical conversion coatings on bare or untreated aluminum, the sealing solution of this invention does not require the presence of a fluoride, e.g., fluosilicate ion, though small amounts of the fluoride ion, i.e., less than 0.1 of a percent by weight of the bath, may be beneficial for sealing anodized aluminum at or near room temperatures. The amount of NaOH solution dispensed at room temperature should not exceed the point where a persistent precipitate is first formed; i.e., the solution becomes and remains slightly cloudy. The process of this invention when applied to sulfuric-anodized aluminum, for example, will exceed 3000 hours salt spray exposure without corrosion of the metal substrate. The process of this invention may also include a room temperature post-treatment in a dilute oxidizer, e.g., 10 ml/l $H_2O_2$ (30%) which will further improve the corrosion resistance particularly when it is desired to use lower bath temperatures or shorter treatment time with the trivalent chromium compounds. A permanganate solution, e.g., 5 g/l $KMnO_4$, may be used as post-treatment but must be followed by rinsing whereas a hydrogen peroxide post-treatment does not require rinsing.

Generally, long term corrosion resistance can be applied to highly corrosion-susceptible aluminum alloys such as 2024-T3 and 7075-T6 that are first anodized and then treated in a bath consisting essentially of chromic sulfate with the proper amount of alkali added. The preferred post-treatment comprises subjecting the seal-coated anodized aluminum to a 0.5 to 10 minutes and preferably 1 to 3 minutes treatment in a 2 to 200 ml/l of $H_2O_2$ (30%) and preferably 5 to 30 ml/l of $H_2O_2$ (30%) in deionized water at 25°–40° C. More specifically, it was found that baths containing chromic sulfate to which an appropriate amount of alkali is added to form more basic soluble compounds could be used to treat anodized aluminum which imparts to the anodic coating a greenish color indicative of adsorption of trivalent chromium compounds. The trivalent compounds act to seal the pores in the anodic coating. Post-treatment in an oxidizing agent converts only a small portion of the trivalent chromium compounds to hexavalent chromium which provides corrosion inhibition and also improves corrosion resistance.

For example, Aluminum 2024-T3 alloy panels were anodized in 15% (weight) sulfuric acid solution for 30 minutes at 21° C. at 18 volts. A trivalent chromium bath was prepared containing 5 g/l $Cr_4(SO_4)_5(OH)_2$ [Fluka Co.; 26% $Cr_2O_3$ and 23–24% $Na_2SO_4$] plus about 20 ml/l 0.5N NaOH for use as a seal for anodized aluminum. The following seals were applied to anodized aluminum.

Water Seal—15 minutes in deionized water at boiling.
Dichromate Seal—15 minutes in 5 g/l $Na_2Cr_2O_7.2H_2O$ at boiling
Trivalent Chromium Seal
A—Two minutes in above bath at boiling; rinse; two minutes in 10 ml/l $H_2O_2$ (30%)
B—15 minutes in above bath at boiling; rinse; two minutes in 10 ml/l $H_2O_2$ (30%)

The panels were exposed to salt spray for over 3000 hours. The water sealed panels had considerable corrosion while the dichromate and trivalent chromium seals were totally uncorroded. Thus, the effectiveness of trivalent chromium seal has been well demonstrated. Immersion of anodized aluminum in the trivalent chromium bath at room temperature provided corrosion resistance superior to water sealed-panels but not quite as resistant as those dichromate sealed.

In formulating the composition of this invention, the trivalent chromium can be added to water in any of its water soluble forms in which the valence is plus 3. For example, the chromium may be incorporated in the form of $Cr_2(SO_4)_3$, $(NH_4)Cr(SO_4)_2$ or $KCr(SO_4)_2$. Mixtures of these compounds may be utilized. The aluminum can be any alloy that is capable of being anodized and the anodizing baths may be, for example, sulfuric acid, oxalic acid, chromic acid, boric acid, sulfophthalic acid or combinations of these. The preferred trivalent chromium compound concentration for "sealing" anodic coatings ranges from about 1.0 to 8.0 grams per liter. The preferred quantity of alkali added to the bath is 4 to 30 ml of 0.5N NaOH equivalent.

Treatment of the anodized surface can be carried out by immersion in the trivalent chromium solution at various temperatures. For example, from ambient temperatures up to the boiling point (100° C.) can be utilized from one to 30 minutes duration, however, bath temperatures 60° to 90° C. for periods of 5 to 20 minutes are preferred.

While various embodiments of the invention have been disclosed, the specific compositions and methods described herein are not intended to limit the scope of the invention.

The invention claimed is:

1. A process for improving the corrosion resistance of anodized aluminum which comprises seal-coating the anodized aluminum in an aqueous acidic solution free of hexavalent chromium and comprising from about 0.1 to 10 grams per liter of a water soluble trivalent chromium compound and a sufficient amount of an alkaline reagent to maintain the aqueous acidic solution at a pH ranging from about 3.3 to 5.5 while forming the trivalent chromium sealer coat on said anodized aluminum and subsequently post-treating said seal-coated anodized aluminum with an effective amount of an oxidizing agent.

2. The process of claim 1 wherein the trivalent chromium compound is a chromium salt.

3. The process of claim 2 wherein the anodized aluminum is seal-coated in the aqueous solution at temperatures ranging from about 60° to 90° C. and the oxidizing agent is an aqueous solution of $H_2O_2$.

4. The process of claim 3 wherein the alkaline reagent is an alkali metal hydroxide and the pH of the aqueous solution ranges from about 4.1 to 4.7.

5. Process of claim 4 wherein the trivalent chromium compound is chromic sulfate and the oxidizing agent is a 2 to 200 ml per liter of $H_2O_2$ (30%) in water.

6. Process of claim 5 wherein the aluminum is an anodized aluminum alloy.

7. Process of claim 1 wherein the anodized aluminum is seal-coated in the aqueous solution at ambient temperatures at a pH ranging from about 3.3 to 3.8.

8. The process of claim 1 wherein the water soluble trivalent chromium compound is present in the aqueous solution in an amount ranging from about 1.0 to 8.0 grams per liter and a fluoride ion is present in an amount less than 0.1 of a percent.

9. The process of claim 1 wherein the seal-coated anodized aluminum is post-treated with an effective amount of a water soluble oxidizing agent converting from nil up to about 2% by weight of the trivalent chromium in the seal-coat to hexavalent chromium.

10. Process of claim 9 wherein the oxidizing agent is an aqueous solution of $H_2O_2$.

11. The process of claim 9 wherein the oxidizing agent comprises an aqueous solution of 5 to 30 ml/l of 30% hydrogen peroxide.

* * * * *